US005692955A

United States Patent [19]

Meyer

[11] Patent Number: 5,692,955

[45] Date of Patent: Dec. 2, 1997

[54] FORCED AIR VENT FOR A ROOF EAVE

[75] Inventor: Stephen T. Meyer, Indianapolis, Ind.

[73] Assignee: Deflecto Corporation, Indianapolis, Ind.

[21] Appl. No.: 713,116

[22] Filed: Sep. 16, 1996

[51] Int. Cl.[6] ..... F23L 17/00

[52] U.S. Cl. ..... 454/354; 454/353; 454/359

[58] Field of Search ..... 454/30, 260, 347, 454/349, 352, 353, 354, 359, 363; 34/235

[56] References Cited

U.S. PATENT DOCUMENTS

| | | | |
|---|---|---|---|
| 5,167,578 | 12/1992 | Legault | 454/354 X |
| 5,383,816 | 1/1995 | Marcello et al. | 454/359 |
| 5,498,204 | 3/1996 | Anderson et al. | 454/359 |

*Primary Examiner*—Harold Joyce
*Attorney, Agent, or Firm*—Woodard, Emhardt, Naughton, Moriarty & McNett

[57] ABSTRACT

A forced air vent for allowing the unidirectional outflow of exhaust air from the interior of a structure into the atmosphere by way of an eave opening includes a generally rectangular main body, arranged with a perforate bottom wall and a pair of oppositely disposed side walls and two hingedly connected movable internal baffle plates. An interior space is defined by the bottom wall and the two oppositely disposed side walls. The perforate bottom wall is arranged with a solid central portion and two oppositely-disposed distal portions. A corresponding abutment ledge is disposed between each distal portion and the central portion. Each distal portion includes a grate panel through which air can freely pass. From a closed position, the baffle plates are movable outwardly and upwardly into an opened position in response to positive air pressure from within the attic interior. The bottom wall has a convex surface protruding into the central portion to focus the air flow onto the baffle plates. The distal portions of the bottom wall each have a convex surface which protrudes outwardly away from the main body to provide a clearance space for pivoting movement of the baffle plates.

9 Claims, 5 Drawing Sheets

FORCED AIR VENT FOR A ROOF EAVE

BACKGROUND OF THE INVENTION

The present invention relates in general to forced air exhaust and venting arrangements for ducting exhaust air from the interior to the exterior of a structure. More specifically the present invention relates to a forced air vent for a roof eave which is designed to accommodate the removal of exhaust air from a clothes dryer or exhaust fan.

There are a number of home installation arrangements where clothes dryer exhaust cannot be vented through a wall to the exterior of the home. This problem also exists in a number of homes with regard to the venting of bathroom fans and other exhaust fans. In order to address this problem, the most typical approach is to route the corresponding exhaust ducting up into and through the attic space of the home. However, under applicable building codes, the exhaust air cannot be expelled into the attic space but must be expelled to the outside atmosphere.

In order to comply with the applicable building codes, one option is to go up and through the roof, using some type of existing roof cap. This approach creates the potential for rain water to leak into the attic space from the area of the roof cap. Accordingly, this option is seen to be less than preferred.

Another option is to route the exhaust air to the area of the roof eave. Since this area is protected from rain, it avoids the primary problem associated with a roof exit location. At the present time, the typical approach is to prepare an opening in the roof eave and bring the exhaust ducting to that location. A screen mesh or open louver vent is then used to cover the roof eave opening.

While the rainwater problem is eliminated with the roof eave location, this particular arrangement allows outside air, particularly cold air, to enter the ducting and travel into the house to the location of the clothes dryer, exhaust fan, vent, or exhaust port. In the reverse direction, hot air which is being used to heat the house is freely escaping through the roof eave opening.

In order to utilize the roof eave location and avoid or eliminate the aforementioned problems, the present invention was conceived. The present invention creates a blocking baffle plate arrangement as part of a vent which blocks the incoming flow of air and yet permits the escape of exhaust air. Since some degree of forced air flow is required in order to open the baffle plates, hot heating air within the house cannot freely escape to the outside atmosphere. The presence of grid-like grate panels on the ends of the present invention vent make it impossible for birds to nest inside the vent.

SUMMARY OF THE INVENTION

A forced air vent for use in connection with the removal of exhaust air from a structure according to one embodiment of the present invention comprises a main body, an interior space defined by the main body, and a pair of baffle plates. The main body includes a perforate bottom wall and a pair of oppositely disposed side walls. The pair of baffle plates are hingedly connected to the main body and are outwardly and upwardly movable with respect to the center of the vent in response to receipt of a positive air pressure.

One object of the present invention is to provide an improved forced air vent.

Related objects and advantages of the present invention will be apparent from the following description.

DESCRIPTION OF THE PREFERRED EMBODIMENT

Figure 1:
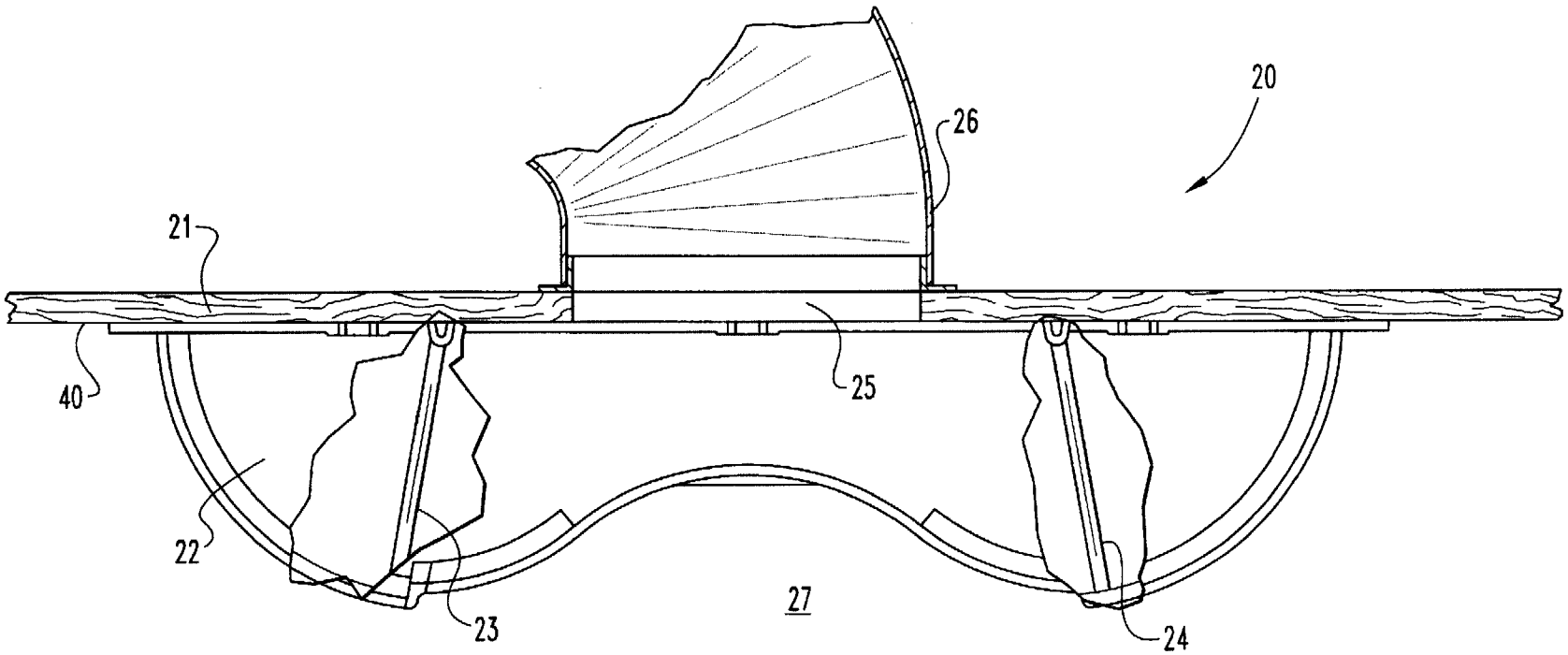
FIG. 1 is a fragmentary, side elevational view of forced air vent according to a typical embodiment of the present invention as installed through a roof eave of a structure.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated an air vent 20 for a roof eave 21 according to the present invention. Air vent 20 includes a unitary, molded main body 22 and a pair of movable baffle plates 23 and 24. The roof eave 21 includes an air flow opening 25 in order to permit air flow between forced air ducting 26 and the outside atmosphere 27. Ducting 26 is representative of the type of conduit used to route dryer exhaust out of the structure. Alternatively ducting 26 could extend from an exhaust fan, vent, or exhaust port within the structure. Vent 20 is designed with the two baffle plates 23 and 24 in order to control the air flow through vent 20 and limit the flow to only an exiting flow.

Figure 2:
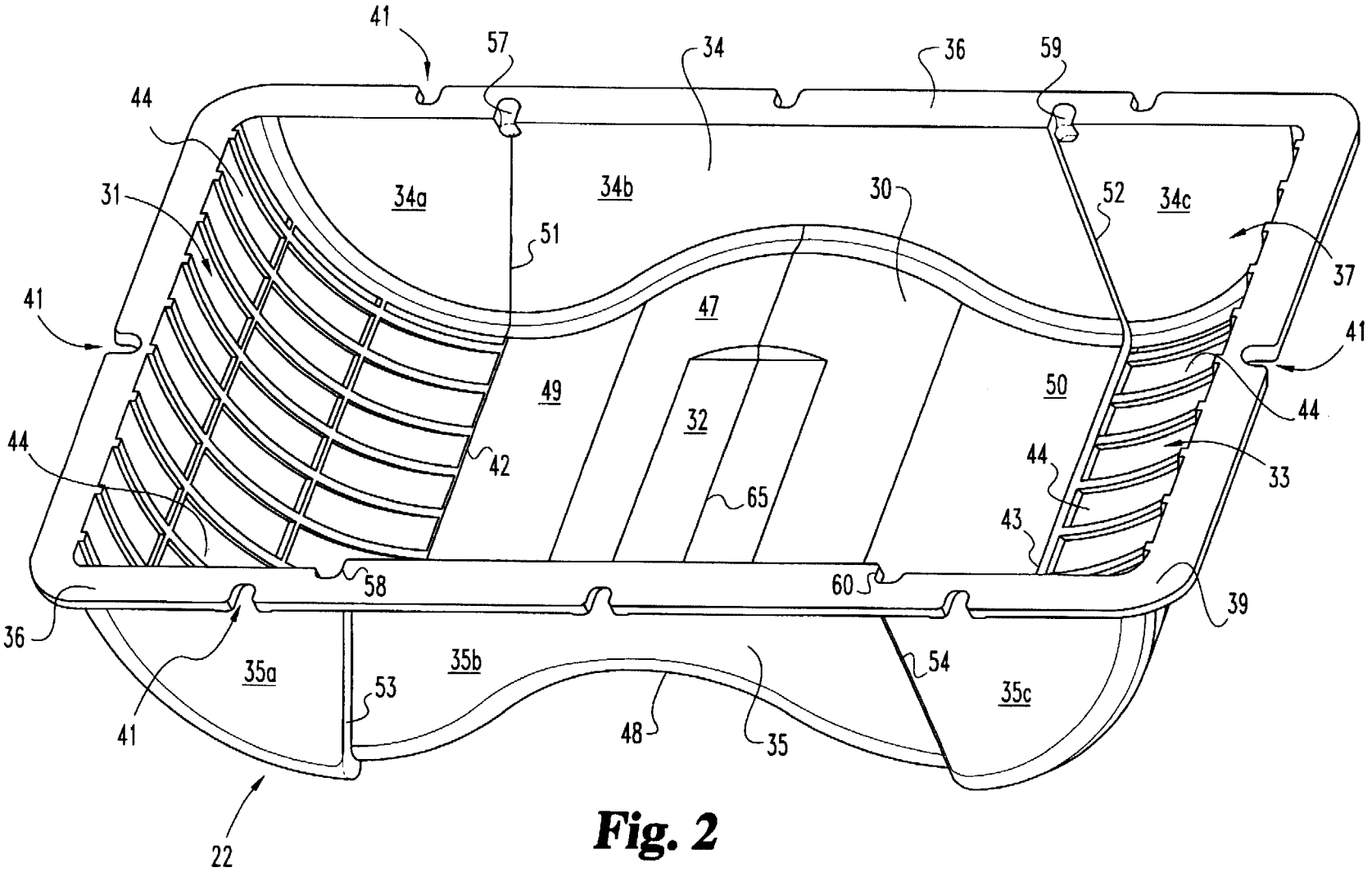
FIG. 2 is a perspective view of the main body of the FIG. 1 forced air vent.

Vent 20 allows exhaust air from within the structure to escape to the atmosphere 27 while not allowing outside atmospheric air to enter the ducting 26 by way of opening 25. Moisture and debris are prevented from either blowing or flowing through vent 20 by the one-way design incorporating the two baffle plates 23 and 24. As illustrated in FIG. 2, there are other features of vent 20 which help to preclude the in-flow of any debris into vent 20. The under-the-eave orientation of vent 20 also facilitates its operation by utilizing the effect of gravity to help keep debris and moisture out of vent 20. Gravity also helps control the movement of baffle plates 23 and 24.

Referring to FIG. 2, the main body 22 is illustrated in greater detail. Main body 22 includes a bottom wall 30 arranged into three distinct portions 31, 32, and 33, a pair of oppositely-disposed sidewalls 34 and 35, and an upper, outwardly extending peripheral flange 36. The bottom wall 30 in combination with the two sidewalls 34 and 35 defines a hollow, interior space 37 which is located within main body 22. Flange 36 includes a substantially flat upper surface 39 which is designed to abut up against the outer surface 40 of eave 21. Mounting apertures 41 provide clearance for the use of conventional threaded fasteners which are to be anchored into roof eave 21 in order to secure vent 20 in position. If an adhesive or caulk is used instead to secure the vent 20 in position on the roof eave, the mounting flange 36 can be considered optional since the upper edges of the two sidewalls 34 and 35 and the upper edges of portions 31 and 33 would provide a suitable abutment surface.

Portions 31 and 33 of bottom wall 30 are configured as smoothly curved (radiused), oppositely-disposed end portions, each of which extends along an approximate 90 degree arc. The approximate 90 degree arc begins at a location which generally corresponds to offset edges 42 (and 43) of portion 32 and extends outwardly and upwardly to its ending location adjacent flange 36. End portions 31 and 33 are sized and shaped in a virtually identical manner so as to maintain a generally symmetric design to vent 20. A longitudinal centerline drawn through the approximate center of vent 20 divides the vent into symmetrical halves which are located on either side of this geometric centerline with sidewall 34 on one side of the centerline and sidewall 35 on the opposite side. Portions 31 and 33 are each designed to provide an open end portion for main body 22. These open end portions are then covered by a grate panel in order to create the perforate appearance for bottom wall 30. With the unitary construction for main body 22, separate grate panels do not actually exist, but functionally this is what is provided. The two grate panels which are integral with portions 31 and 33 make it impossible for birds to nest inside of vent 20.

Each end portion 31 and 33 includes a plurality of substantially rectangular openings 44 which are uniformly arranged into a row and column pattern. Openings 44 provide the exit locations for whatever flow passes through opening 25 and into vent 20. As is described hereinafter, the two baffle plates limit the flow through vent 20 to only one direction. While air flow is able to leave the ducting 26 by way of opening 25 and flow through vent 20, any reverse or backflow into vent 20 which could conceivably flow back into the ducting is blocked by the two baffle plates and the manner in which those two baffle plates abut up against abutment edges disposed as part of main body 22.

Center portion 32 is solid throughout and has a curved contour such that it has a convex inner surface 47 and a concave outer surface 48 (see FIG. 1). The ends 49 and 50 of portion 32 actually begin to curve in the opposite direction from the remainder of portion 32. In this way, the entirety of bottom wall 30 can be viewed from the outside or from the exterior as being contoured with a convex section (portion 31 and end 49) which smoothly transitions into a concave section (portion 32, including a small part of ends 49 and 50) which in turn smoothly transitions into a convex section (portion 33 and end 50).

Each sidewall 34 and 35 is arranged into three distinct portions 34*a*, 34*b*, and 34*c* (for sidewall 34) and portions 35*a*, 35*b*, and 35*c* (for sidewall 35). While each of the six sidewall portions are substantially flat and planar, interface edges 51, 52, 53, and 54 create an offset between adjacent portions. Portions 34*a* and 34*b* are separated by edge 51 while portions 34*b* and 34*c* are separated by edge 52. In a similar manner, portions 35*a* and 35*b* are separated by edge 53 while portions 35*b* and 35*c* are separated by edge 54. Coplanar edges 51, 53, and 42 are aligned with each other such that an imaginary geometric plane which is co-extensive with each edge is substantially perpendicular to each of the six portions 34*a*–34*c*and 35*a*–35*c*. Coplanar edges 52, 54, and 43 also lie within a corresponding imaginary geometric plane which is co-extensive with these three edges and is substantially perpendicular to each of the six portions 34*a*–34*c* and 35*a*–35*c*.

Each edge 51 and 53 is inclined and each one extends outwardly away from portions 34*b*, 35*b*, and 32 as it extends downwardly away from flange 36. A similar edge direction and incline exists for edges 52 and 54. Accordingly, edges 51 and 52 have a converging orientation in the direction of flange 36, as do edges 53 and 54. Edges 51, 53, and 42 provide an abutment lip for baffle plate 23 and edges 52, 54, and 43 provide an abutment lip for baffle plate 24 (see FIG. 3). By shifting the orientation of the baffle plates 23 and 24 off of vertical, as is clear due to the converging nature of edges 51 and 53 and the converging nature of edges 52 and 54, it is easy for the baffle plates to pivot upwardly and outwardly in response to the flow of exit air out through opening 25 and into interior space 37. Equally important is the fact that the inclined orientation of each baffle plate 23 and 24 (see FIG. 1) enables gravity to continue to act on the baffle plates to hold them against the corresponding edges in order to establish a sealed interface and preclude any noticeable backflow of air through vent 20 into opening 25. Vent 20 controls the flow of air through opening 25 and limits the flow through opening 25 to one direction (i.e., to only exiting flow).

Figure 3:
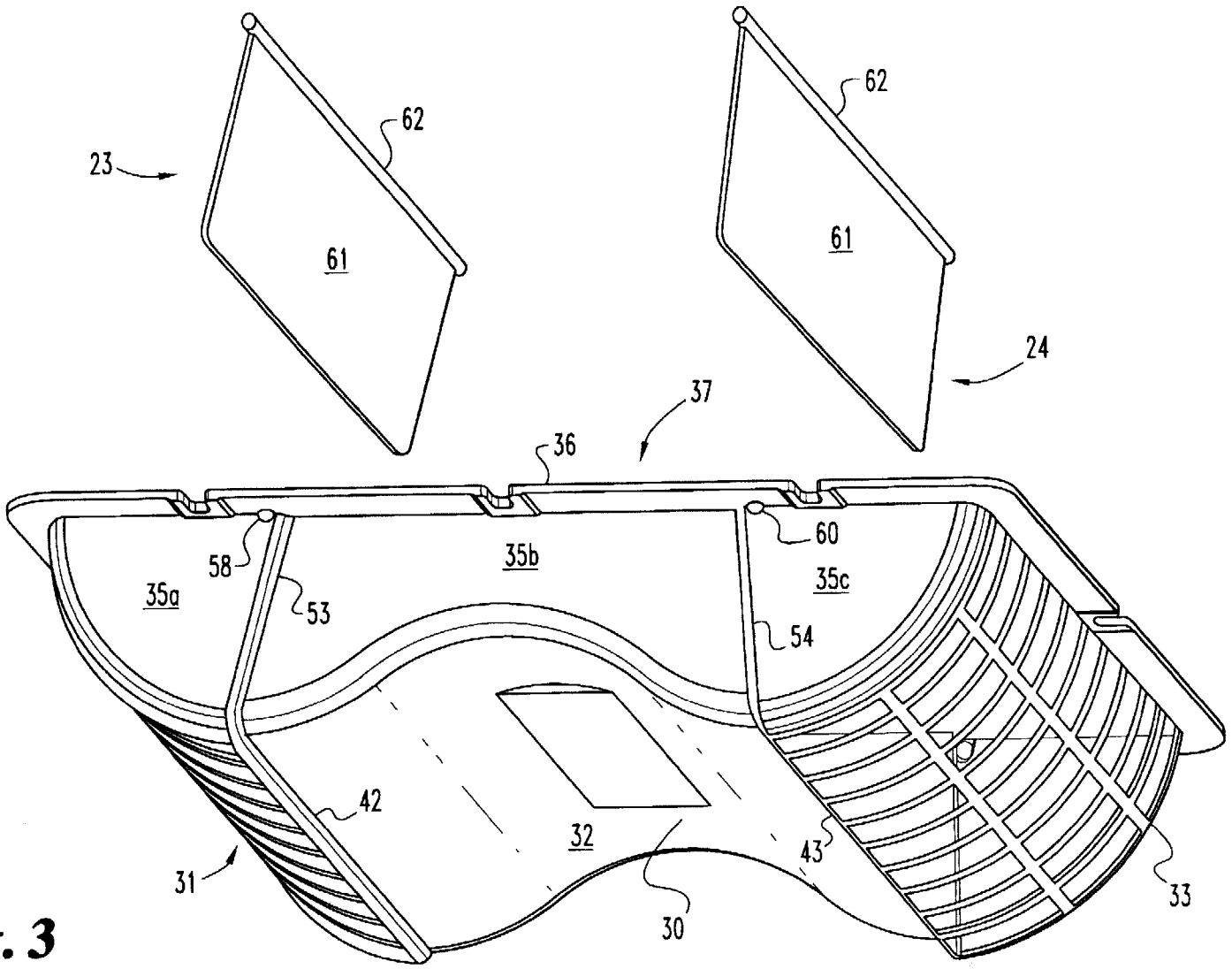
FIG. 3 is an exploded, perspective view of the FIG. 1 forced air vent showing the location of two baffle plates according to the present invention.

Disposed in portion 34*a* is a hinge aperture 57 which is located adjacent the upper end of edge 51. On the opposite side (see FIG. 3), an aligned hinge aperture 58 is located adjacent the upper end of edge 53. A virtually identical arrangement exists relative to edges 52 and 54 by means of hinge apertures 59 and 60. With reference to FIG. 3, it will be seen that each baffle plate 23 and 24 includes a substantially rectangular body portion 61 and a pivot or hinge pin portion 62. Each baffle plate is a unitary, molded plastic member and is specifically designed to be light weight and durable. The hinge pin portion 62 includes a longitudinal axis which coincides with the axis of rotation for each baffle plate relative to the four hinge apertures 57–60. The ends of each hinge pin portion 62 of each baffle plate extend beyond the side edges of the corresponding body portion of each baffle plate and are thus able to readily drop down into hinge apertures 57–60. If a mounting flange 36 is included as part of vent 20, each of the hinge apertures actually cuts through part of the flange so that the hinge pin portions can simply be lowered into position. There is no interlocking arrangement nor any snap-in design required in order to retain the hinge pin portions 62 in position in the various hinge apertures 57–60. As will be understood, although the baffle plates can simply drop down into the various hinge apertures 57–60, the baffle plates will be held in position when the vent 20 is mounted to the roof eave 21. The outer surface 40 of the roof eave provides an enclosing member directly against the open top of the hinge apertures 57–60 so as to securely retain the four hinge pin portions 62.

Figure 4:
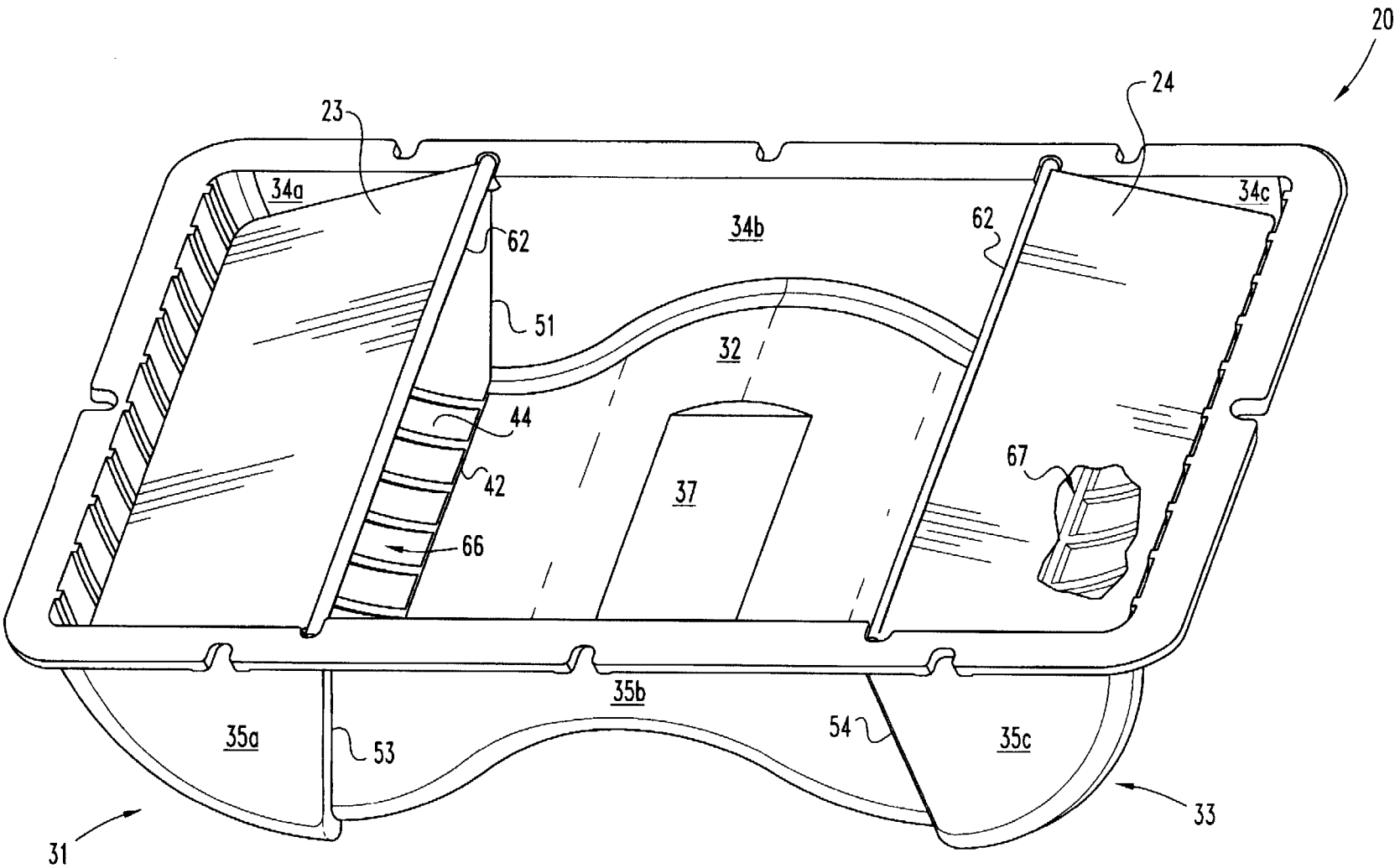
FIG. 4 is a perspective view of the FIG. 1 forced air vent with the baffle plates pivoted into an open-to-air-flow position.
Figure 5:
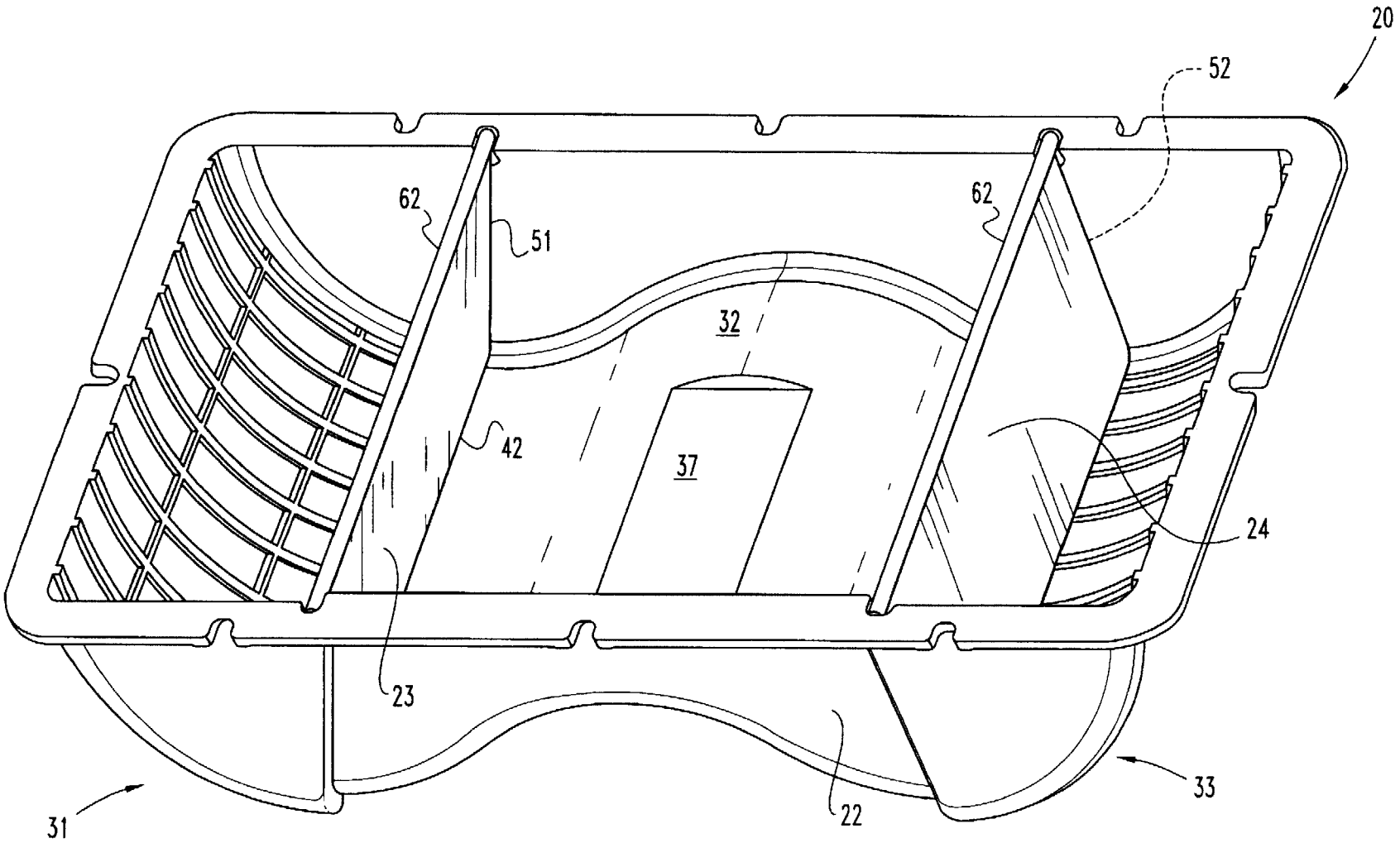
FIG. 5 is a perspective view of the FIG. 1 forced air vent with the baffle plates pivoted into a closed-to-air-flow position.

Additionally referring to FIGS. 4 and 5, the movement of baffle plates 23 and 24 relative to main body 22 is illustrated. When air flow exits ducting 26 and opening 25 (see FIG. 1), it flows downwardly into interior space 37. In order for the in-coming flow to split somewhat evenly so as to have two oppositely-directed flow branches, it is important that vent 20 be installed onto the roof eave 21 in such a way that vent 20 is geometrically centered in both length and width dimensions over opening 25. By centering vent 20 directly over roof eave opening 25, it is possible to ensure that the center or apex of convex portion 32 will be generally centered relative to opening 25. In view of this relationship and the construction of vent 20, the in-coming flow out of opening 25 and into interior space 37 branches off or splits into two oppositely-disposed flow paths, one on each side of the geometric centerline 65 of portion 32. The convex curvature of portion 32 and the raised orientation of portion 32 which extends upwardly toward opening 25 forces each of the two flow paths in a downward and outward direction. This in turn focuses the exit flow of each path along and toward the lower edge of each baffle plate 23 and 24. As should be understood, one flow branch flows downwardly along the surface of portion 32 and is thus directed at the lower edge of baffle plate 23. A flow path in the opposite direction extends downwardly along the surface of portion 32 on the other side of centerline 65 and is thus directed towards the lower edge of baffle plate 24. By directing and focusing the flow path of the exiting air well below the pivoting axis of the hinge pin portion 62 of each baffle plate, the baffle plates 23 and 24 are able to open more easily and require less air force in order to pivot to an open condition. If portion 32 is flat throughout (planar), the in-coming flow would not necessarily be split into two somewhat balanced, oppositely-disposed flow paths. More importantly, with a planar center portion 32 there would not be an opportunity to direct the flow of each branch in the direction of the lower edge of the corresponding one of the two baffle plates. If a portion of the exiting flow in each direction is directed along the pivoting axis line of the corresponding baffle plate, a much greater force level would be required due to the cantilever design of the baffle plate mounting. If more force was required in order to pivot the baffle plates to an open condition, there is less likelihood that all of the air which should vent out of the attic would be permitted to do so. The greater the distance of separation between the pivoting axis and the impingement location of the exiting flow against the baffle plate, the less force required in order to open the baffle plates.

As the two baffle plates pivot upwardly and outwardly off of their abutment edges, an opening 66 and 67 is created between the lower edge of each baffle plate and bottom wall 30. These two openings provide flow communication with the openings 44 in the two grate-like (perforate) end portions 31 and 33.

In the FIG. 4 illustration, the baffle plates 23 and 24 are in an open condition which is created by an exiting flow of air from opening 25. When the existing flow of air is removed, gravity returns the two baffle plates 23 and 24 to a closed condition against their corresponding abutment edges as it illustrated in FIG. 5. There are of course numerous positions in between the two extremes of FIG. 4 and FIG. 5. Depending on the force of air exiting through opening 25, and depending on the weight of the baffle plates, the baffle plates which assume a corresponding orientation between a closed condition and a fully open condition. However, by focusing and directing the exiting air along the lower edge of the baffle plates, virtually any degree of forced air flow exiting from ducting 26 will achieve some degree of opening to the two baffle plates.

In the closed condition of FIG. 5, any back flow of air into end portions 31 and 33 will push against the baffle plates which simply increases the abutment force against the abutment edges 42, 43, 51, 52, 53, and 54. By sizing the two baffle plates to fit closely to portions 34*a*, 34*c*, 35*a*, and 35*c*, there is effectively no pathway open that would admit any backflow of air into opening 25.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An air vent for controlling the air flow into and out of a structure, said air vent comprising;

a main body including a perforate bottom wall and a pair of oppositely disposed side walls which are positioned along said bottom wall so as to define therewith an interior space, said bottom wall having a solid central portion and an open grate distal portion, said solid central portion having a concave exterior surface and a convex interior surface protruding into said interior space and said distal portion having a convex exterior surface protruding outwardly of said interior space; and a movable baffle plate disposed within said interior space for controlling the flow of air through said air vent and said baffle plate being hingedly connected to said main body of said air vent.

2. The air vent of claim 1 wherein said main body is a unitary molded plastic member.

3. An air vent comprising:

a main body including a bottom wall and a pair of enclosing side walls, said bottom wall being shaded with two open end portions and a solid central panel, each of said open end portions being separated from said solid central panel by a corresponding abutment ledge; and a pair of movable baffle plates hingedly connected to said main body and positioned to control the flow of air through said open end portions, wherein each open end portion is constructed and arranged with a convex grate panel.

4. An air vent comprising:

a main body including a bottom wall and a pair of enclosing side walls, said bottom wall being shaded with two open end portions and a solid central panel, each of said open end portions being separated from said solid central panel by a corresponding abutment ledge; and a pair of movable baffle plate hingedly connected to said main body and positioned to control the flow of air through said open end portions, wherein said solid central panel of said bottom wall having a convex curvature protruding into said interior space.

5. The air vent of claim 4 wherein the main body is a unitary molded plastic member.

6. An air vent comprising:

a main body including a bottom wall and a pair of enclosing side walls, said bottom wall being shaped with two open end portion and a solid central panel, each of said open end portions being separated from said solid central panel by a corresponding abutment ledge; and a pair of movable baffle plates hingedly connected to said main body and positioned to control the flow of air through said open end portions, wherein said solid central panel of said bottom wall having a convex surface protruding into said interior space and each of said open end portions of said bottom wall having a convex curvature protruding out from said interior space.

7. An air vent comprising;

a main body including a perforate bottom wall and a pair of oppositely disposed side walls, said pair of side walls positioned along said bottom wall to define an interior space, said bottom wall having a central portion and a plurality of distal portions, said central portion having a concave curvature and each of said distal portions including a grate panel; and a plurality of movable baffle plates hingedly connected to said main body, each of said plurality of movable baffle plates being constructed and arranged to control the flow of air through the corresponding grate panel, wherein each of said plurality of distal portions has a convex curvature.

8. The air vent of claim 7 wherein said distal portions are arranged symmetrically with respect to said main body.

9. The air vent of claim 7 wherein said main body is a unitary molded plastic member.

* * * * *